US006432850B1

(12) United States Patent
Takagi et al.

(10) Patent No.: US 6,432,850 B1
(45) Date of Patent: Aug. 13, 2002

(54) FABRICS AND RUST PROOF CLOTHES EXCELLENT IN CONDUCTIVITY AND ANTISTATIC PROPERTY

(75) Inventors: Susumu Takagi; Yutaka Matsui, both of Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/282,982

(22) Filed: Mar. 31, 1999

(30) Foreign Application Priority Data

Mar. 31, 1998 (JP) ..... 10-086220

(51) Int. Cl.[7] ..... D03D 15/00; D02G 3/00

(52) U.S. Cl. ..... 442/190; 442/189; 442/191; 442/199; 442/200; 442/203; 442/208; 442/209; 442/217; 442/301; 428/373; 57/210; 57/230; 57/235; 57/243; 57/244

(58) Field of Search ..... 442/190, 191, 442/301, 189, 203, 199, 200, 208, 209, 217; 428/373; 57/210, 230, 235, 243, 244

(56) References Cited

U.S. PATENT DOCUMENTS 4,582,747 A * 4/1986 Hirakawa et al. ..... 428/229
4,921,751 A * 5/1990 Wakahara et al. ..... 428/229

* cited by examiner

*Primary Examiner*—Terrel Morris
*Assistant Examiner*—Ula C. Ruddock
(74) *Attorney, Agent, or Firm*—Dilworth & Barrese, LLP

(57) ABSTRACT

There are provided fabrics excellent in electrical conductane and antistatic property as well as dust proof clothes using the same. Conductive yarn comprising synthetic filament yarn as the core covered with conductive bicomponent fibers is used as conductive yarn used in the warps and/or wefts at intervals.

7 Claims, 3 Drawing Sheets

FABRICS AND RUST PROOF CLOTHES EXCELLENT IN CONDUCTIVITY AND ANTISTATIC PROPERTY

FIELD OF THE INVENTION

The present invention relates to fabrics excellent in conductivity and antistatic property as well as dust proof clothes sewed therefrom, which are electroconductive throughout the dust proof clothes and excellent in durability and antistatic property.

BACKGROUND OF THE INVENTION

Conventionally, yarn composed of electroconductive (hereinafter referred to "conductive") fibers and non-conductive synthetic fibers is woven into fabrics for dust proof clothes for a measure against static electricity. Fabrics into which yarn containing these conductive fibers has been woven are conductive in the warp and weft directions along which the conductive fibers have been woven, not only in the case where yarn containing conductive fibers is mixed and woven in a striped pattern at predetermined intervals, but also in the case where the yarn is woven in a check-striped pattern, but satisfactory conductance cannot be obtained in a slanting direction of fabric, and therefore, it is difficult to achieve electrical conductance throughout dust proof fabrics. The reason for this is that conductive fiber introduced into the warp and conductive fiber introduced into the weft are in poor electrical contact with each other.

Further, in dust proof clothes formed from these fabrics, it is difficult to achieve electrical conductance in the sewn portions, and it is further difficult to achieve electrical conductance throughout the dust proof clothes.

The reason is that the conductive yarns in the respective fabrics are not in electrical contact with each other even in the sewn portios.

If conductive yarn composed exclusively of conductive fibers is woven in the case where conductive yarn is woven into fabrics, differences in fiber characteristics such as strength, elongation, shrinkage etc. occur between the conductive fibers and other fibers constituting the fabrics, thus readily causing various drawbacks such as fiber cutting, puckering etc. at the time of weaving and processing. Further, because the conductive fibers are more expensive than general fiber materials, it is also important to reduce the amount thereof for use.

Accordingly, conductive fibers are mixed with fibers similar to fibers used in the base constituting fabrics by means of inter-twisting, air confounding etc., and the yarns thus obtained are generally used.

In the case where these conductive yarns are mixed in a striped pattern at predetermined intervals in weaving of fabric, the resulting fabric is conductive in the direction along which the conductive fibers have been woven, but cannot be conductive in other directions.

Further, even in the case where these conductive yarns are woven in a check-striped pattern at predetermined intervals, there is electrical conductance in the directions such as warp and weft directions along which the conductive yarns have been woven, but the conductive yarns woven into the warp and the conductive yarns woven into the weft are not in electrical contact with each other, so it is difficult to achieve satisfactory electrical conductance in a slanting direction of the fabric, and as a result, it is difficult to achieve satisfactory electrical conductance throughout the fabric.

This is caused by the fact that the conductive fibers are buried inside of the yarn so that the contact between the conductive fibers inserted into the yarn as the warp and the conductive fibers inserted into the yarn as the weft is deteriorated.

Further, the conductive fibers are buried inside of the yarn, thus deteriorating antistatic property and simultaneously raising the contact resistance between the conductive fibers and the outside, so the sewn portions in contact under low contact pressure in sewing the fabric are hardly rendered conductive.

As described above, the conventional dust proof clothes suffer from the two problems, that is, fabrics used in each portion of the dust proof clothes cannot achieve good electrical conductance throughout the fabrics, and upon sewing of the respective portions, electrical conductance in the sewn portions cannot be stably obtained, so it is difficult to achieve electrical conductance throughout the dust proof clothes.

As a method of improving antistatic property, JP60-28546A describes a method of improving the performance of dissipating static electricity by raising conductive fibers to the surface of fabric to form a parallel and check-striped pattern. In this prior art method, however, the mutual contact between the conductive fibers formed in the warp and those in the weft are not sufficient, and the electrical conductance of the resulting fabric in a slanting direction is hardly obtained. Further, the conductive fibers are raised to the surface of the fabric, and the conductive fibers have a larger diameter than that of non-conductive fibers in the base constituting the fabric, so there is a problem with abrasion durability.

JP-A 55-135014 describes that for improvement of the electrical conductance of sewn portions in dust proof clothes, the portions to be sewn are sewed such that yarn containing conductive fibers as a part of sewing threads is brought into electrical contact with the end of conductive fibers mixed in fabric.

In this case, however, electrical contact in the sewn portion is sometimes deteriorated when drawbacks such as puckering are appeared in the sewn portion due to repeated wearings and washings.

JP-A 58-160209 describes clothes in which a conductive material is arranged at overlap portions or butted portions of fabric having conductive fibers woven at suitable intervals, so that the respective portions are an electrical contact with one another. In this case, however, there is an economical problem because the conductive material should be arranged at the cloth overlap portions or the butted portions, and there is a further problem with the durability of the conductive material itself to be arranged.

OBJECT OF THE INVENTION

The object of the present invention is to provide fabrics excellent in conductivity and antistatic property as well as dust proof clothes being electrically conductive throughout the dust proof clothes and further excellent in durability and antistatic property, to solve the problems described above.

SUMMARY OF THE INVENTION

First, the present invention resides in fabrics comprising warps and/or wefts containing electrically conductive yarn at intervals, characterized in that the electrically conductive yarn is structured by covering synthetic filament yarn as the core with conductive bicomponent fibers.

Second, the present invention resides in the above-described fabrics wherein the conductive yarn is structured by double-covering synthetic filament yarn as the core with conductive bicomponent fibers.

Thirdly, the present invention resides in the above-described fabrics wherein the conductive yarn is contained in both of the warps and wefts at intervals thereof and that in one is structured by double-covering synthetic filament yarn as the core with conductive bicomponent fibers and the other is structured by single-covering synthetic filament yarn as the core with conductive bicomponent fibers.

Fourthly, the present invention resides in the above-described fabrics wherein the conductive yarn is contained in both of the warps and wefts at intervals thereof and that in one is structured by double-covering synthetic filament yarn as the core with conductive bicomponent fibers and the other is double-twisted yarn composed of synthetic filament yarn and conductive bicomponent fibers.

Fifthly, the present invention resides in the above-described fabrics wherein the degree of coverage of the conductive bicomponent fiber in the conductive yarn is 20 to 70%.

Sixthly, the present invention resides in the above-described fabrics wherein the conductive bicomponent fiber comprises carbon and the electric resistance thereof is $10^6$–$10^9$ Ω/cm.

Seventhly, the present invention resides in the above-described fabrics wherein the conductive bicomponent fiber is obtained by bicomponent spinning a non-conductive base polymer and a matrix polymer containing carbon as conductive component such that at least a part of the latter is exposed to the surface of fibers.

Eighthly, the present invention resides in dust proof clothes comprising the above-described fabrics.

Ninethly, the present invention resides in the above-described dust proof clothes comprising fabrics stitched together using sewing thread containing 30 to 100% by weight of conductive bicomponent fibers containing carbon and having an electric resistance of $10^6$–$10^9$ Ω/cm.

Tenthly, the present invention resides in the above-described dust proof clothes wherein conductive fibers containing in the sewing thread are obtained by bicomponent-spinning a non-conductive base polymer and a matrix polymer containing carbon as conductive component such that at least a part of the latter is exposed to the surface of fibers.

Eleventhly, the present invention resides in the above-described dust proof clothes wherein the resistance of a portion including sewn portions is $10^9$Ω or less.

DETAILED DESCRIPTION OF THE INVENTION

In the fabrics of the invention, the conductive yarn used as the warp and weft is structured by covering synthetic filament yarn as the core with conductive bicomponent fibers, and in particular the conductive yarn used as at least one of the warp and weft is preferably structured by double-covering synthetic filament yarn as the core with conductive bicomponent fibers, and particularly preferably the conductive yarn used as at least one of the warp and weft is structured by double-covering synthetic filament yarn as the core with conductive bicomponent fibers while the other is structured by single-covering synthetic filament yarn as the core with conductive bicomponent fibers.

Synthetic filament yarn used as the core of the conductive yarn may be substantially the same as that constituting the base of fabrics for clothes. Specific examples of its materials include polyester (polyethylene terephthalate etc.), polyamide (nylon 6, nylon 66, etc.) etc., among which the polyester is most preferable for chemical stability and handling property. For example, polyester filament yarn or polyeser finished yarn such as polyester false twisted yarn, which has 0.1 to 5 denier in finesses as single fiber and 50 to 200 denier in total fineness, is preferably used.

The conductive fibers for covering (non-conductive) synthetic filament yarn includes yarns comprising metal-coated synthetic filaments bicomponent fibers obtained by bicomponent spinning a base polymer as fiber substrate and a conductive polymer having fine particles of a conductive material such as carbon, metal or metal compound dispersed in a matrix polymer. The latter bicomponent spun fiber using carbon as a conductive material is most preferable.

Insofar as a part of (the conductive polymer containing) the conductive material in the bicomponent fiber is exposed to the surface, the sectional shape are not particularly limited. One example of its sectional shape is shown in FIG. 1. In FIG. 1, 1 is a base polymer (non-conductive polymer) layer and 2 is an electrically conductive polymer layer.

By way of example, the conductive bicomponent fibers of 1 to 5 denier in finesses as single fiber or of 10 to 200 denier preferably 10 to 100 denier in total fineness is preferably used. It is preferable for friction resistance that conductive bicomponent fiber has a finesses not more than that of yarn constituting the base of textile, and preferably, the resistance thereof is usually $10^9$ Ω/cm or less, particularly $10^8$ Ω/cm or less.

Conductive yarn is produced by covering preferably double-covering the (non-conductive) synthetic filament yarn as the core with the conductive bicomponent fibers.

The degree of coverage of the conductive fiber in the conductive yarn in the double-covering structure is the proportion of the conductive fiber when viewed from the side of the conductive yarn as shown in FIG. 2, and this degree is shown in the following formula.

Degree (%) of coverage of conductive fiber=area of conductive fiber/area of conductive yarn×100.

Although the degree of coverage of the conductive fiber is preferably as high as possible, the degree of coverage of the conductive fiber is preferably 20 to 70% in consideration of the processability, manufacturing, costs, conductivity etc. of the conductive yarn. Given 20% or less, the effect of electrical conductance is hardly obtained. In the case of 70% or more, electrical conductance is hardly obtained. In the case of 70% or more, electrical conductance can be sufficiently obtained, but even if the conductive fiber is mixed at such high ratios, no particular effect cannot be obtained, resulting in higher costs.

The degree of coverage of the conductive fiber in the conductive yarn is raised in this manner, and the yarn is structured by double-covering the fiber by simultaneously winding the upper and lower fiber in the opposite direction to generate friction resistance by which the covering conductive fiber can be prevented from slipping at the time of yarn processing and textile manufacturing.

By use of this structure of conductive yarn, physical properties of conductive yarn, such as strength etc. can be secured stably. Further, because the conductive fiber is exposed to the surface of the yarn, the contact between the conductive fiber of the conductive yarn inserted into the warp and the conductive fiber of the conductive yarn inserted into the weft is improved whereby the electrical conductance of fabrics in all directions including a slanting direction can be secured. Further, if dust proof clothes is made of such fabrics, the contact resistance in sewn portions can be reduced even in contact under low contact pressure in weaving the fabrics, and thus the electrical conductance among the sewn portions can be secured. Further, by such structure, fabrics also excellent in antistatic propeorty can be provided.

Further, the fineness of the conductive yarn is made in the same range as non-conductive fibers constituting other portions in fabrics whereby the friction durability can also be improved without causing the conductive yarn to be protruded from the fabrics.

The pitch of the conductive yarn to be mixed is 1 yarn/3 cm or more, preferably 1 yarn/cm, in both the warp and weft directions.

By such structure, the resistance of fabric measured in the method shown in FIG. 3 can be $10^6$ to $10^9\Omega$, and in particular the resistance of fabric in a slanting direction, as measured in the method shown in FIG. 4, can be $10^6$ to $10^9\Omega$.

Fabrics using the conductive yarn where the degree of coverage of the conductive fiber is in the above range enable the electrical conductance of the fabrics in all directions and can simultaneously reduce resistance stably to secure excellent electrical control.

By sewing the above fabrics together, it is easy to obtain the electrical conductance among the sewn portions, and it is possible to obtain not only fabrics but also dust proof clothes having electrical conductance throughout the dust proof clothes. Further the sewn portions have been sewn by use of sewing thread containing the conductive fiber, whereby stable electrical conductance can be secured even if puckering occurs after repetition of wearing, washing etc. In other words, in the case where the electrical conductance between the adjacent fabrics in deteriorated due to puckering, the conductive fibers in the fabric and those in the sewing thread are contacted each other, and as a result stable electrical conductance can be secured.

The conductive fibers used in the sewn portions include yarns comprising metal-coated synthetic filaments bicomponent fibers obtained by bicomponent spinning a base polymer as fiber substrate and a conductive polymer having fine particles of a conductive material such as carbon, metal or metal compound dispersed in a matrix polymer. However, fibers covered with a metal or conductive fibers comprising a metal as an conductive component have a problem with durability due to elution or removal of the metal under acidic or alkaline environments, so it is preferable to use the same conductive bicomponent spinned yarn as described above for covering. The latter bicomponent spun fiber using carbon as a conductive material is most preferable.

Insofar as a part of (the conductive polymer containing) the conductive material in the bicomponent fiber is exposed to the surface, the sectional shape are not particularly limited. One example of its sectional shape is shown in FIG. 1.

By way of example, the conductive bicomponent fibers of 1 to 5 denier in finesses as single fiber or of 10 to 200 denier preferably 10 to 100 denier in total fineness is preferably used. The resistance thereof is usually $10^9$ Ω/cm or less, particularly $10^8$ Ω/cm or less.

As the sewing thread, it is preferable to use that containing 30 to 100% by weight of such conductive bicomponent fibers. If the content of the conductive fibers is 30% by weight or less, it is difficult to obtain a durable electrical conductance stably among sewn portions.

Conductive yarn having such conductive fibers mixed with non-conductive fibers can be used as the sewing thread to attain sewn portions having electrical conductance and being excellent in durability even if puckering occurs in the sewn portions after repetition of wearing, washing etc.

The resistance of such conductive yarn is also preferably $10^9$ Ω/cm or less, particularly $10^8$ Ω/cm or less. The fineness of the sewing thread is preferably in the range of 180 to 360 denier.

Dust proof clothes produced by sewing the fabrics of the invention with the sewing thread described above, even upon generation of static electricity in any portion of the dust proof clothes, can be easily earthed owing to stable electrical conductance throughout the fabrics and dust proof clothes, and further are excellent in durability and antistatic property.

EXAMPLES

Hereinafter, the examples of the invention are described.

Evaluation methods are as follows:

[Surface Resistance of Fabric] (warp direction)

As shown in FIG. 3, a surface resistor (ST-3, SIMUKO) was placed on a fabric specimen with a width of 5 cm and a length of 5 cm or more, and its surface resistance was measured. 10 specimens were measured in warp direction to determine an average.

[Surface Resistance of Fabric] (slanting direction)

Determined as shown in FIG. 4.

[Resistance of Sewing Thread]

As shown in FIG. 5, a surface resistance meter (ST-3, SIMUKO) was placed quietly on one sewing thread and its resistance was measured.

10 specimens were measured to determine an average.

[Durability of Weft Yarn]

A fabric sewn by the lock stitch of polyester taffeta (stitch number: 14) was worn 30 times in accordance with a method described in method C, JIS L1096 abrasion resistance and the degree of abrasion was judged with the eye (Wearing Ring No. CS10, a loading of 250 gf).

(Judgment Criteria)

Good: The sewing thread is slightly damaged.

Medium: The sewing thread is considerably damaged.

Bad: The sewing thread is cut.

[Chemical Durability of Sewing Thread]

Conducted in accordance with the Cas test described in JIS H8502 (method of tesing corrosion resistance of plating). A specimen was sewn by the lock stitch of 1 $dm^2$ polyester taffeta by passing sewing thread therethrough at a stitch number of 14.

The test time was 24 hours and the specimen was evaluated according to the following criteria.

Good: Corrosion is not observed in the portion of conductive fiber.

Bad: Corrosion is observed in the portion of conductive fiber.

[Resistance in Sewn Portions]

As shown in FIG. 6, two textiles were wound and sewn such that the angle (θ) between the yarns containing conductive fiber in the warp was made 5°.

A clip electrode was attached to the sewed specimen, and its resistance was measured in SIMUKO surface resistance meter ST-3.

[Resistance of Dust Proof Clothes]

As shown in FIG. 7, a clip electrode was attached to sewed clothes to determine resistance.

[Fabric Durability]

A fabric was worn 5000 times in accordance with E method described in JIS L1096 abrasion resistance and the degree of abrasion was judged with eye.

Example 1

Polyester filament yarn 75*d*–36*f* was used as the warp and polyester false twisted yarn 100*d*–48*f* was used as the weft to form a textile as the base. As conductive yarn in the warp, polyester filament yarn 30*d*–12*f* was covered by S-twist with Beltron B31 (Kanebo, Ltd.) 20*d*–6*f* at 600 T/m and further covered thereon by Z-twist with Beltron B31 (Kanebo, Ltd.) 20*d*–6*f* at 480 T/m whereby conductive yarn constructed by double-covering wherein the degree of coverage of the conductive fiber was 65% was prepared. The resulting yarns were inserted at the ratio of 1:30 into the yarns of the above textile. As conductive yarn in the weft, covered thread prepared by single-covering polyester filament yarn 50*d*–24*f* by S-twist with Beltron B31 (Kanebo, Ltd.) 20*d*–6*f* at 600 T/m wherein the degree of coverage of the conductive fiber was 30%, was also inserted at the ratio of 1:20 into the yarns of the above textile, whereby plain weave fabric having a warp density of 160 yarns/inch. and a weft density of 105 yarns/inch was produced. Separately, one thread of polyester filament yarn 40*d*–18*f* and two threads of Beltron B31 (Kanebo, Ltd.) 20*d*–6*f* were twisted together by S-twist at 600 T/m to give a string, and 3 strings thus prepared were twisted together by Z-twist at 480 T/m to prepare sewing thread. Dust proof clothes were produced by winding and sewing the above plain weave fabric with the sewing thread. The performance thereof is shown in Tables 1, 2, 3 and 4.

Example 2

Polyester filament yarn 75*d*–36*f* was used as the warp and polyester false twisted yarn 100*d*–48*f* was used as the weft to form a textile as the base. As conductive yarn in the warp, polyester filament yarn 30*d*–12*f* was covered by S-twist with Beltron B31 (Kanebo, Ltd.) 20*d*–6*f* at 600 T/m and further covered thereon by Z-twist with Beltron B31 (Kanebo, Ltd.) 20*d*–6*f* at 480 T/m whereby conductive yarn constructed by double-covering wherein the degree of coverage of the conductive fiber was 65% was prepared. The resulting yarns were inserted at the ratio of 1:30 into the yarns of the above textile. As conductive yarn in the weft, single-covered thread prepared by covering polyester filament yarn 75*d*–36*f* by S-twist with Beltron B31 (Kanebo, Ltd.) 20*d*–6*f* at 600 T/m wherein the degree of coverage of the conductive fiber was 28%, was also inserted at the ratio of 1:20 into the yarns of the above textile, whereby 2/3 twill fabric having a warp density of 160 yarns/inch and a weft density of 110 yarns/inch was produced. Separately, one thread of polyester filament yarn 40*d* 18*f* and two threads of Beltron B31 (Kanebo, Ltd.) 20*d*–6*f* were twisted together by S-twist at 600 T/m to give a string, and 3 strings thus prepared were twisted together by Z-twist at 480 T/m to prepare sewing thread. Dust proof clothes were produced by winding and sewing the above twill fabric with the sewing thread. The performance thereof is shown in Tables 1 and 2.

Example 3

Polyester filament yarn 75*d*–36*f* was used as the warp and polyester false twisted yarn 100*d*–48*f* was used as the weft to form the base portion of textile. As conductive yarn in the warp, polyester filament yarn 30*d*–12*f* was covered by S-twist with Beltron B31 (Kanebo, Ltd.) 20*d*–6*f* at 600 T/m and further covered thereon by Z-twist with Beltron B31 (Kanebo, Ltd.) 20*d*–6*f* at 480 T/m whereby electrically conductive yarn constructed by double-covering wherein the degree of coverage of the conductive fiber was 65% was prepared. The resulting yarns were inserted at the ratio of 1:30 into the yarns of the above textile. As electrically conductive yarn in the weft, covered thread prepared by twisting finished yarn 75*d*–36*f* having polyester temporarily sewn therein and Beltron B31 (Kanebo, Ltd.) 20*d*–6*f* together by S-twist at 600 T/m wherein the degree of coverage of the conductive fiber was 26%, was also inserted at the ratio of 1:20 into the yarns of the above textile, whereby plain weave fabric having a warp density of 160 yarns/inch and a weft density of 85 yarns/inch was produced. Separately, one thread of polyester filament yarn 40*d*–18*f* and two threads of Beltron B31 (Kanebo, Ltd.) 20*d*–6*f* were twisted together by S-twist at 600 T/m to give a string, and 3 strings thus prepared were twisted together by Z-twist at 480 T/m to prepare sewing thread. Dust proof clothes were produced by winding and sewing the above plain weave fabric with the sewing thread. The performance thereof is shown in Tables 1 and 2.

Comparative Example 1

Polyester filament yarn 75*d*–36*f* was used as the warp and polyester false twisted yarn 75*d*–36*f* was used as the weft to form a textile. As conductive yarn in the warp, polyester filament yarn 30*d*–12*f* was covered by S-twist with Beltron B31 (Kanebo, Ltd.) 20*d*–6*f* at 600 T/m and further covered thereon by Z-twist with Beltron B31 (Kanebo, Ltd.) 20*d*–6*f* at 480 T/m whereby conductive yarn constructed by double-covering wherein the degree of coverage of the conductive fiber was 65% was prepared, and the resulting yarns were inserted at the ratio of 1:30 into the yarns of the above textile, whereby plain weave fabric having a warp density of 160 yarns/inch and a weft density of 105 yarns/inch was produced. Separately, one thread of polyester filament yarn 40*d*–18*f* and two threads of Beltron B31 (Kanebo, Ltd.) 20*d*–6*f* were twisted together by S-twist at 600 T/m to give a string, and 3 strings thus prepared were twisted together by Z-twist at 480 T/m to prepare sewing thread. Dust proof clothes were produced by winding and sewing the above plain weave fabric with the sewing thread. The performance thereof is shown in Tables 1 and 2.

Comparative Example 2

Polyester filament yarn 75*d*–36*f* was used as the warp and polyester false twisted yarn 75*d*–36*f* was used as the weft to form a textile as the base. As conductive yarn in the warp, polyester filament yarn 50*d*–24*f* was interlaced with Beltron B31 (Kanebo, Ltd.) 20*d*–6*f* whereby conductive yarn wherein the degree of coverage of the conductive fiber was 15% was prepared. The resulting yarns were inserted at the ratio of 1:30 into the yarns of the above textile. As electrically conductive yarn in the weft, covered thread having a degree of coverage of the conductive fiber of 15% prepared by covering polyester false twisted yarn 50*d*–24*f* *interlaced with Beltron B*31 (Kanebo, Ltd.) 20*d*–6*f* was also inserted at the ratio of 1:20 into the yarns of the above textile, whereby plain weave fabric having a warp density of 160 yarns/inch and a weft density of 105 yarns/inch was produced. Separately, one thread of polyester filament yarn 40*d*–18*f* and two threads of Beltron B31 (Kanebo, Ltd.) 20*d*–6*f* were twisted together by S-twist at 600 T/m to give a string, and 3 strings thus prepared were twisted together by Z-twist at 480 T/m to prepare sewing thread. Dust proof clothes were produced by winding and sewing the above plain weave fabric with the sewing thread. The performance thereof is shown in Tables 1 and 2.

Comparative Example 3

Polyester filament yarn 75*d*–36*f* was used as the warp and polyester false twisted yarn 75*d*–36*f* was used as the weft to form a textile as the base. As electrically conductive yarn in the warp, polyester filament yarn 100*d*–48*f* was twisted by S-twisting at 600 T/m with Beltron B31 (Kanebo, Ltd.) 20*d*–6*f* whereby conductive yarn wherein the degree of coverage of the conductive fiber was 18% was prepared. The resulting yarns were inserted at the ratio of 1:30 into the yarns of the above textile. As conductive yarn in the weft, polyester false twisted yarn 100*d*–48*f* was twisted by S-twisting at 600 T/m with Beltron B31 (Kanebo, Ltd.) 20*d*–6*f* whereby conductive yarn having a degree of coverage of electrically conductive fiber of 16% was prepared. The resulting yarns were also inserted at the ratio of 1:20 into the yarns of the above textile, whereby plain weave fabric having a warp density of 160 yarns/inch and a weft density of 105 yarns/inch was produced. Separately, one thread of polyester filament yarn 40*d*–18*f* and two threads of Beltron B31 (Kanebo, Ltd.) 20*d*–6*f* were twisted together by S-twist at 600 T/m to give a string, and 3 strings thus prepared were twisted together by Z-twist at 480 T/m to prepare sewing thread. Dust proof clothes were produced by winding and sewing the above plain weave fabric with the sewing thread. The performance thereof is shown in Tables 1 and 2.

Comparative Example 4

Polyester filament yarn 75*d*–24*f* was twisted by Z-twist at 400 T/m to give a string, and 3 strings thus obtained were twisted together by S-twist at 280 T/m to give sewing thread. The fabric in Example 1 was wound and sewn by use of this sewing thread. The performance thereof is shown in Tables 3 and 4.

Comparative Example 5

Polyester filament yarn 100*d*–34*f* was silver-plated and twisted by S-twist at 600 T/m to give a string, and 3 strings thus obtained were twisted together by Z-twist at 480 T/m to give sewing thread. Dust proof clothes were produced by use of this sewing thread. The performance thereof is shown in Tables 3 and 4.

TABLE 1

| | | | Example 1 | Example 2 | Example 3 | Comparative Example 1 | Comparative Example 2 | Comparative Example 3 |
|---|---|---|---|---|---|---|---|---|
| Fabrics | Yarn in the base | Warp | PET 75d-36f | PET 75d-36f | PET 75d-36f | PET 75d-36f | PET 75d-36f | PET 75d-36f |
| | | Weft | PET 75d-36f finished yarn | PET 100d-45f finished yarn | PET 100d-48f finished yarn | PET 75d-36f finished yarn | PET 75d-36f finished yarn | PET 75d-36f finished yarn |
| | Conductive yarn | Warp | Double-covering PET 30d-12f with Beltron B31 20d-6f and Beltron B31 20d-6f | Double-covering PET 30d-12f with Beltron B31 20d-6f end Beltron 331 20d-6f | Double-covering PET 30d-12f with Beltron B31 20d-6f and Beltron B31 20d-6f | Double-covering PET 30d-12f with Beltron 331 20d-6f and Beltron B31 20d-6f | Interlacing PET 50d-24f with Beltron B31 20d-6f | Twisting PET 100d-48f with Beltron B31 20d-6f |
| | | Degree of coverage of warp | 65% | 65% | 65% | 65% | 15% | 18% |
| | | Weft | Single-covering PET 50d-24f finished yarn with Beltron B31 20d-6f | Single-covering PET 75d-36f finished yarn with Beltron B31 20d-6f | Twisting PET 75d-36f finished yarn with Beltron B31 20d-6f | | Interlacing PET 50d-24f with Beltron B31 20d-6f | Twisting PET 100d-48f with Beltron B31 20d-6f |
| | | Degree of coverage of Weft | 30% | 28% | 26% | | 15% | 18% |
| | Resistance (Ω) | Weft direction | $10^{7.5}$ | $10^{7.5}$ | $10^{7.7}$ | $10^{11.0}$ | $10^{9.7}$ | $10^{9.1}$ |
| | | Slanting direction | $10^{7.4}$ | $10^{7.5}$ | $10^{7.6}$ | $10^{11.9}$ | $10^{12}$ | $10^{10.8}$ |
| | Fabric durability | | good | good | good | good | good | bad |

TABLE 2

| | Example 1 | Example 2 | Example 3 | Comparative Example 1 | Comparative Example 2 | Comparative Example 3 |
|---|---|---|---|---|---|---|
| Sewing thread | | | | | | |
| Yarn | 3 strings of one PET 40d-18f twisted with two Beltron B31 20d-6f were twisted together | | | | | |
| Resistance (Ω) | $10^{7.5}$ | | | | | |
| friction resistance | good | | | | | |
| Chemical durability | good | | | | | |
| Resistance in sewn portion (Ω) | | | | | | |
| Initial | $10^{8.0}$ | $10^{8.0}$ | $10^{8.1}$ | $10^{8.3}$ | $10^{9.8}$ | $10^{8.8}$ |
| After 100-times washing | $10^{8.1}$ | $10^{8.1}$ | $10^{8.2}$ | $10^{8.3}$ | $10^{11.8}$ | $10^{10.9}$ |
| Resistance of dust-proof clothes (Ω) | | | | | | |
| Initial | $10^{8.0}$ | $10^{8.0}$ | $10^{8.1}$ | $10^{11.3}$ | $10^{9.9}$ | $10^{9.3}$ |
| After 100-times washing | $10^{8.0}$ | $10^{8.1}$ | $10^{8.2}$ | $10^{11.7}$ | $10^{12.0}$ | $10^{11.3}$ |

TABLE 3

| | | | Example 1 | Comparative Example 4 | Comparative Example 5 |
|---|---|---|---|---|---|
| Fabrics | Yarn in the base | Warp direction | PET 75d-36f | | |
| | | Weft direction | PET 75d-36f finished yarn | | |
| | Conductive yarn | Warp direction | Double-covering PET 30d-12f with Beltron B31 20d-6f | | |
| | | Degree of coverage in warp direction | 65% | | |
| | | Weft direction | Single-covering PET 30d-24 finished yarn with Beltron B31 20d-6f | | |
| | | Degree of coverage in weft direction | 30% | | |
| | Resistance (Ω) | Warp direction | | $10^{7.2}$ | |
| | | Slanting direction | | $10^{7.4}$ | |

TABLE 4

| | Example 1 | Comparative Example 4 | Comparative Example 5 |
|---|---|---|---|
| Sewing thread | | | |
| Yarn | 3 strings of one PET 40d-18f twisted with two Beltron B31 20d-6f were twisted together | 3 strings of PET 75d-24f were twisted at S 280T/m | 3 silver-plated PET 100d-34f yarns were twisted together |
| Resistance (Ω) | $10^{7.5}$ | $10^{12.0}$ | $10^{2.0}$ |
| Friction resistance | good | good | medium |
| Chemical durability | good | good | bad |
| Resistance in sewn portion (Ω) | | | |
| Initial | $10^{8.0}$ | $10^{8.0}$ | $10^{7.7}$ |
| After 100-times washing | $10^{8.1}$ | $10^{12.0}$ | $10^{10.0}$ |
| Resistance of dust-proof clothes (Ω) | | | |
| Initial | $10^{8.0}$ | $10^{8.2}$ | $10^{8.0}$ |
| After 100-times washing | $10^{8.0}$ | $10^{11.0}$ | $10^{10.0}$ |

Effects of the Invention

According to the present invention as described above, there can be provided dust proof clothes capable of efficiently removing static electricity by use of earthing thereof because the dust proof clothes are electrically conductive in all directions of fabrics constituting the dust proof clothes, are excellent in electrical conductance throughout the dust proof clothes including sewn portions, and are also excellent in durable electrical conductance even after repetition of wearing and washing.

Figure 1:
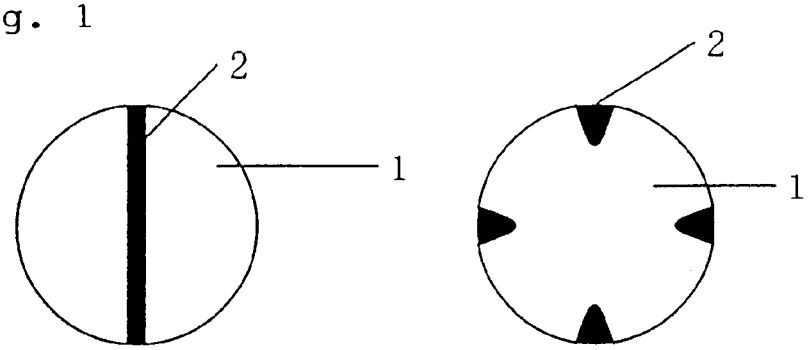
FIG. 1 is a sectional view showing one example of the bicomponent fiber.
Figure 2:
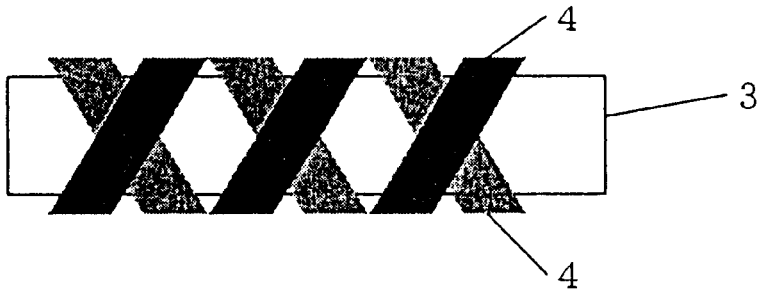
FIG. 2 is a sectional view showing the double-covering structure.
Figure 3:
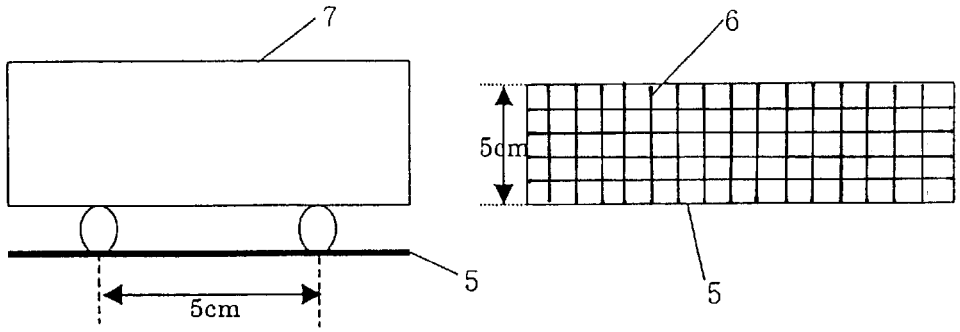
FIG. 3 is a drawing showing the method of measuring the surface resistance (warp and weft directions) of fabric.
Figure 4:
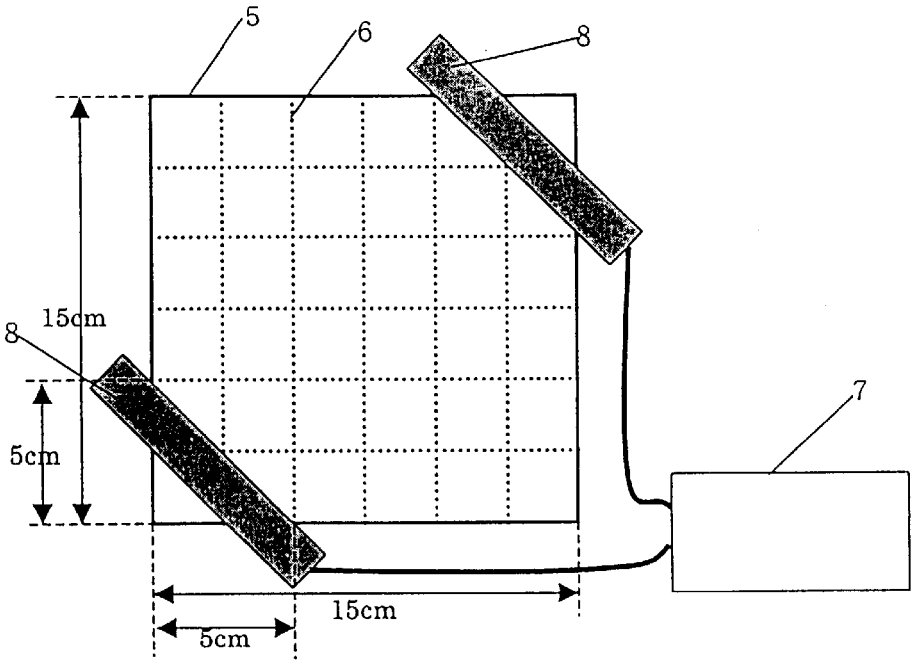
FIG. 4 is a drawing showing the method of measuring the surface resistance (slanting direction) of fabric.
Figure 5:
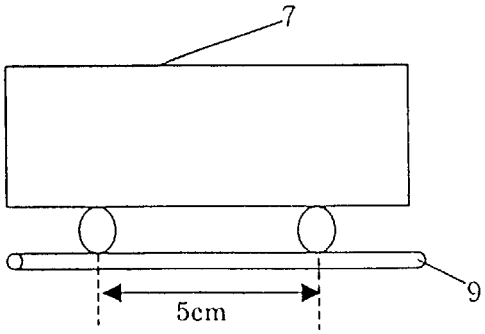
FIG. 5 is a drawing showing the method of measuring the resistance of sewing thread.
Figure 6:
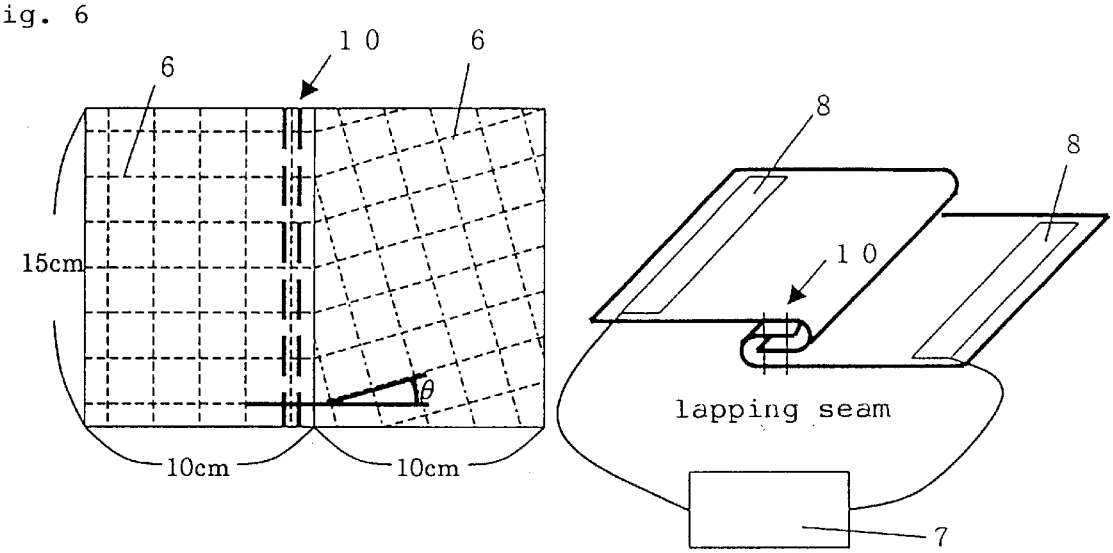
FIG. 6 is a drawing showing the method of measuring the resistance of sewn portions.
Figure 7:
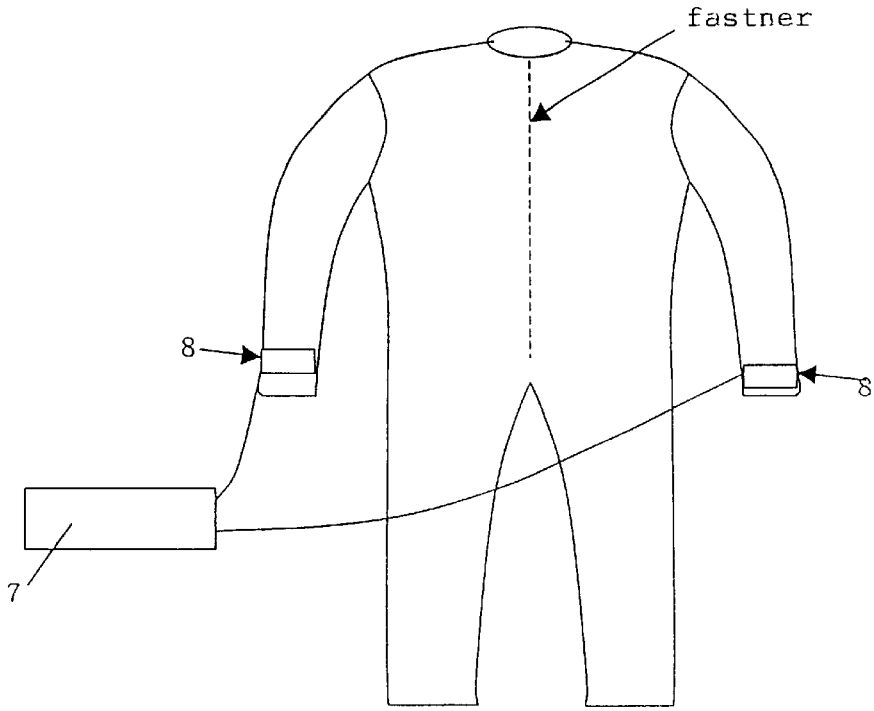
FIG. 7 is a drawing showing the method of measuring the resistance of dust proof clothes.

In the drawings, 1 is a base polymer layer, 2 is an electrically conductive polymer layer, 3 is synthetic filament yarn, 4 is conductive fiber, 5 is a specimen, 6 is conductive yarn, 7 is a Resistance measuring apparatus (SIMUKO ST-3), 8 is an electrode, 9 is a sewing thread and 10 is a sewn portion.

What is claimed is:

1. Woven fabrics comprising warps and/or wefts containing electrically conductive yarn at intervals, wherein the electrically conductive yarn is a covered yarn obtained by winding electrically conductive bicomponent fiber yarn around synthetic filament yarn.

2. Fabrics according to claim 1 wherein the conductive yarn is obtained by winding the electrically conductive bicomponent fiber yarn twice around the synthetic filament yarn.

3. Fabrics according to claim 1 wherein the conductive yarn is contained in both of the warps and wefts at intervals thereof and that in one of said warps and wefts the conductive yarn is obtained by winding the electrically conductive bicomponent fiber twice around the synthetic filament yarn and in the other of said warps and wefts the conductive yarn is obtained by winding the conductive bicomponent fiber once around the synthetic filament yarn.

4. Fabrics according to claim 1 wherein the conductive yarn is contained in both of the warps and wefts at intervals thereof and that in one of said warps and wefts the conductive yarn is obtained by winding the electrically conductive bicomponent fiber twice around the synthetic filament yarn and in the other of said warps and wefts the conductive yarn is obtained by double twisting the synthetic filament yarn with the conductive bicomponent fiber.

5. Fabrics according to claim 1 wherein the conductive bicomponent fiber comprises carbon, the electrical resistance of said conductive bicomponent fiber being from about $10^6$ to $10^9$ Ω/cm.

6. Fabric according to claim 1 wherein the conductive bicomponent fiber is obtained by bicomponent spinning a non-conductive base polymer and a matrix polymer containing carbon as a conductive component such that at least a part of the matrix polymer containing carbon is exposed to the surface of the fiber.

7. Woven fabrics comprising warps and/or wefts containing electrically conductive yarn at intervals, wherein the electrically conductive yarn is a covered yarn obtained by winding electrically conductive bicomponent fiber yarn around synthetic filament yarn, wherein the degree of coverage of the conductive bicomponent fiber in the conductive yarn is 20% to 70%, wherein said degree of coverage is the percentage of the area of the conductive yarn which is covered by the conductive bicomponent fiber.

* * * * *